United States Patent [19]

Chiba et al.

[11] 4,217,568

[45] Aug. 12, 1980

[54] MAGNETIC POLE PIECES FOR USE IN A NUCLEAR MAGNETIC RESONANCE APPARATUS

[75] Inventors: Akio Chiba; Hiromichi Imahashi, both of Hitachi; Sadami Tomita; Yoshiharu Utsumi, both of Katsuta, all of Japan

[73] Assignee: Hitachi, Ltd., Japan

[21] Appl. No.: 847,491

[22] Filed: Nov. 1, 1977

[30] Foreign Application Priority Data

Nov. 4, 1976 [JP] Japan ..... 51/131765

[51] Int. Cl.[2] ..... H01F 3/00; H01F 7/00

[52] U.S. Cl. ..... 335/298; 335/296

[58] Field of Search ..... 335/281, 296, 297, 298

[56] References Cited

U.S. PATENT DOCUMENTS 3,662,304 5/1972 Bringe et al. ..... 335/297

FOREIGN PATENT DOCUMENTS 1490564 6/1967 France ..... 335/298

*Primary Examiner*—Fred L. Braun

*Attorney, Agent, or Firm*—Craig and Antonelli

[57] ABSTRACT

A non-magnetic metal for integral casting is poured into a mold supporting a couple of magnetic pole pieces with a distance piece placed therebetween. The pole pieces are thus fixed as cast integrally with the mold, and subsequently the distance piece is removed so that there are provided magnetic pole pieces of the type best suited to a nuclear magnetic resonance apparatus, etc.

13 Claims, 5 Drawing Figures

MAGNETIC POLE PIECES FOR USE IN A NUCLEAR MAGNETIC RESONANCE APPARATUS

LIST OF PRIOR ART REFERENCES

The following reference is cited to show the state of the art. U.S. Pat. No. 3,611,223, Utsumi et al., Oct. 5, 1971.

The present invention relates to magnetic pole pieces for use in an atomic spectro-absorption analyzing apparatus, nuclear magnetic resonance apparatus etc. and a method of manufacture therefor, and more particularly to magnetic pole pieces incorporated in a uniform magnetic field generating device for preferred use in a nuclear magnetic resonance analyzing apparatus for measurement of magnetism in atomic nuclei or electrons and a method of manufacture therefor.

Because of its significantly high magnetic resolution power, the nuclear magnetic resonance analyzing apparatus for measurement of magnetism in atomic nuclei or electrons has been in common use as a useful apparatus to study molecular formula or structural formula in chemical substances.

FIG. 1 is a schematic view showing the principle of a nuclear magnetic resonance apparatus. As shown in FIG. 1, a test piece 1 is disposed between a couple of magnets 2, 3 which form a high, uniform unidirectional polarized magnetic field. To this test piece 1 is applied a high-frequency magnetic field provided by a high-frequency oscillator 4 and a high-frequency coil 5 in a direction perpendicular to the above-described unidirectional polarized magnetic field. By accurate and correct combination of these two magnetic fields, there will be brought about the action of nuclear magnetic resonance absorption in atomic nuclei of the test piece 1. Electric signals in response to the absorption, then, are sensed by a detector 6 to be displayed. In this manner, the studies of molecular formula, etc. of the test piece 1 are effected.

In the above mentioned nuclear magnetic resonance analysis, it is necessary for polarization of molecular and nuclear particles in the direction of magnetic field to provide an intensified magnetic field as much as from several thousand to several ten thousand oersteds. To provide such an intensified magnetic field, there has so far been in practice a method of using an air gap magnetic field.

The distribution of magnetic field in the gap mentioned above is required to be exceedingly uniform in the range of below $10^{-5}$ through $10^{-7}$ oersteds with respect to the operating magnetic field. Accordingly, there have been used magnetic poles made of a homogeneous magnetic material (hereinafter referred to as "pole pieces").

The pole pieces are mounted in opposition to each other in the air gap of the magnet, and generally it is necessitated in design for provision of uniform magnetic field distribution in the air gap that the pole pieces be mounted with the rate of alignment not exceeding several ten microns while the rate of parallelism between them being less than several microns.

FIG. 2 is a cross-sectional view showing how the pole pieces are conventionally mounted in a nuclear magnetic resonance apparatus. In this Figure, a couple of pole pieces 11 are disposed in opposition to each other and with a predetermined gap therebetween in a test piece accommodating cavity 17. The pole pieces are either fixed by fastening screws to nonmagnetic blocks 12 through which the test piece accommodating hole is formed, or bonded securely at 14. The extent of alignment and parallelism of the pole pieces are adjusted through a minor movement thereof by means of externally accessible adjustment holes 15 and adjustment screws 16.

With such prior art arrangement of the pole pieces, however, there have been the drawbacks that the procedure of adjusting the alignment and parallelism thereof not only needs high skills for performance of hard jobs but also involves even after the adjustment occurrences of changes in relative dimension of the pole pieces due to minor vibrations or shocks or such changes caused from secular changes of the mountings, so that the reliability of the nuclear magnetic resonance apparatus is deteriorated with respect to its stability of resolution.

To eliminate or reduce the above drawbacks, there has been an attempt to integrally fix the pole pieces thus dispensing with mechanical adjustments thereof. For example, it is known to form complementary joints on the pole pieces by precision machining and they are fixed together through interlocking or screw fastening or bonding. Nevertheless, all of these processes include a lot of manual work and so lack in accuracy, reliability, etc. They do not substantially differ from the above described mechanical adjustment.

This invention has an object to eliminate the above prior art drawbacks by providing magnetic pole pieces and a method of manufacture therefor which pole pieces are for use in a nuclear magnetic resonance apparatus with improved accuracies and reliabilities.

To accomplish this object, according to the invention, there are provided featured steps including: placing a couple of magnetic pole pieces with a distance piece interposed therebetween in a mold; after having adjusted the parallelism and alignment therebetween, pouring a non-magnetic casting binder in the mold thereby casting the pole pieces integrally; and subsequently removing the distance piece from the casting.

As mentioned earlier, it is necessary for provision of a uniform magnetic field formed around the air gap of the magnet in a nuclear magnetic resonance apparatus that the parallelism error in the pole pieces be less than several microns while the alignment error therein being less than several ten microns. According to the invention, however, the assembly of pole pieces with an insert member (herein referred to as "distance piece") interposed therebetween, which insert member having a sufficient accuracy in dimension and accurate flat plate surfaces, is dimensionally adjusted, integrally casting bound and thereafter the distance piece is removed, so that the predetermined accuracy in dimension described above will be secured. Preferably, the distance piece is selected among soft materials of the nature which have no reaction on the integral casting binder and does not injure the surfaces of the pole pieces either. And, it also preferably has the coefficient of thermal expansion not exceeding $5\times10^{-6}$ in view of security of the predetermined dimensions described above. As such material of the distance piece, there are for example carbon, molybdenum, tungsten, etc. which may be fiber reinforced. Of these, carbon is best fit in use. Further, the pole pieces may be made of for example iron-cobalt alloy (1:1).

It is desired that the mold to be used according to the invention has a coefficient of thermal expansion greater than that of the distance piece. By use of such specific mold, it is made possible to instantly remove the distance piece after having integrally casting bounded the pole pieces. The mold usually has a coefficient of thermal expansion more than $13\times10^{-6}$, and as its material carbon steel for example may be used.

Figure 5:
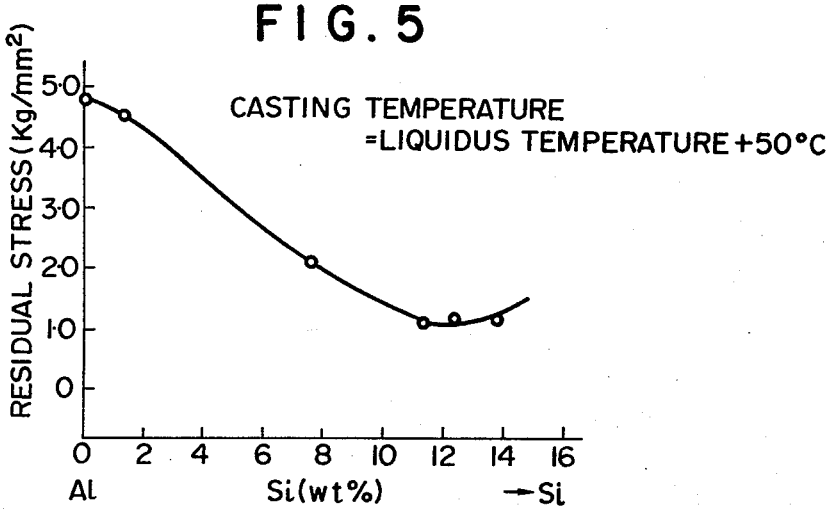
FIG. 5 is also a graphic representation of the relation between the residual stress of post-cast Al-Si alloy and the component of the alloy.

The integral casting binder to be employed in the invention is required to be characterized by: being of a non-magnetic metal having no magnetic influence upon the pole pieces; its melting point being lower than a magnet annealing temperature to avoid deterioration in quality of the pole pieces (the term "magnet annealing temperature" means an annealing temperature to provide a uniform magnetic properties, and in case of the pole piece being made of Fe-Co alloy, it is 700° C. to 850° C); good fluidity shown at the time of pouring; and high stability in dimension. Its coefficient of thermal expansion is preferred to be more than $13\times10^{-6}$. To meet those requirements, there are recommended such materials for example as aluminum, aluminum-silicon alloy, zinc, bismuth, etc. Further, the requirement of dimensional stability mentioned above is essential for the reasons that follow. As described before, the pole pieces have to be fixed in a dimensional accuracy of the order of several microns. In the invention, meanwhile, the pole pieces and integral casting binder are to be cast together into one body, this resulting in occurrence of casting stresses. Hence, when the integrally formed pole pieces are left at room temperature, there may be caused dimensional changes in the pole pieces due to changes of residual stresses in the integrally cast part. When further effecting annealing at a relatively high temperature to eliminate those residual stresses, there may occur looseness between the integral casting binder and the pole pieces, which again causes dimensional changes. For this reason, it is preferred that the integral casting binder as cast has less residual stresses and at a relatively low temperature its residual stresses can be substantially entirely eliminated. As one of those integral casting binder best fitted to the above requirement, there is Al—Si alloy composed of 8 to 13% silicon and aluminum for the remainder. FIG. 5 shows the relation between residual stresses in the post-cast Al-Si alloy and components of alloy, which reveals that in case the content of Si is 8% to 13% the residual stress becomes small.

Table 1 shows some examples of coefficient of thermal expansion of the above-mentioned members to be employed in the invention.

TABLE 1

| | | Temperature (°C.) | Coefficient of thermal expansion |
|---|---|---|---|
| Pole piece | | 500 | $13.1\times10^{-6}$ |
| | W | 500 | $4.6\times10^{-6}$ |
| Distance | Mo | 27 | $5.0\times10^{-6}$ |

TABLE 1-continued

| | | Temperature (°C.) | Coefficient of thermal expansion |
|---|---|---|---|
| piece | C | 27 | $2.8\times10^{-6}$ |
| Mold | | 500 | $13.6\times10^{-6}$ |
| Casting binder (Al) | | 400 | $26.49\times10^{-6}$ |

In the invention, the members when the pole pieces are integrally cast are adjusted of their relative dimensions in view of thermal expansion and contraction, as follows. The pole pieces are securely fixed in the mold by means of shrinkage fit, etc., a distance piece being disposed between the pole pieces. The rate of parallelism and alignment in the pole pieces are adjusted by means of screws, etc. within the predetermined range of tolerance described earlier, and subsequently the integral casting binder is poured into the mold. Preferably, the members have respective coefficients of thermal expansion for pre-heating and integral casting in such manner as increasing in value in the order of the distance piece, integral casting binder and mold. In this manner, it is made easy to remove the distance piece after the integral casting.

The invention will now be described in conjunction with the drawings.

Figure 1:
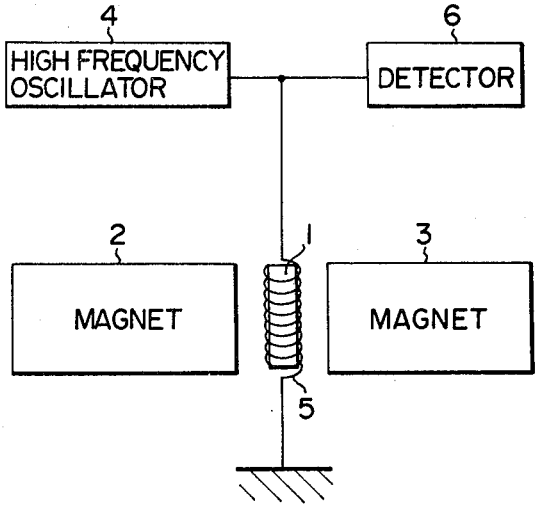
FIG. 1 is a schematic view showing the principle of a nuclear magnetic resonance apparatus.
Figure 3:
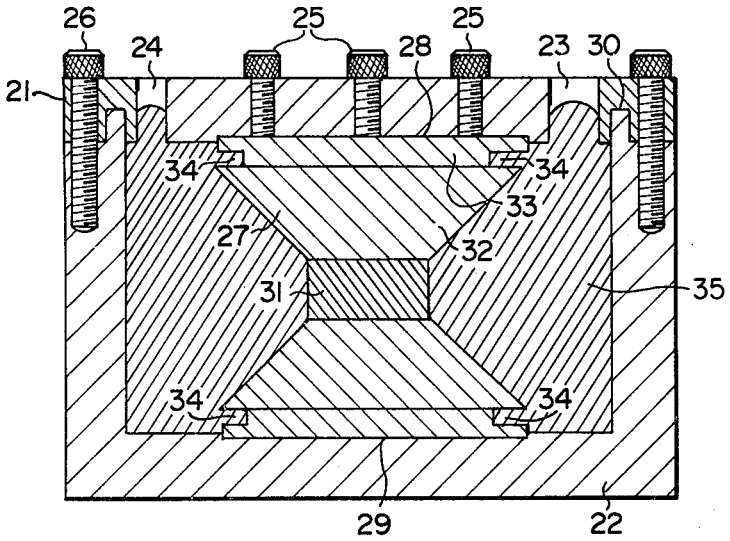
FIG. 3 is a sectional view showing a process to manufacture magnetic pole pieces according to the invention.
Figure 2:
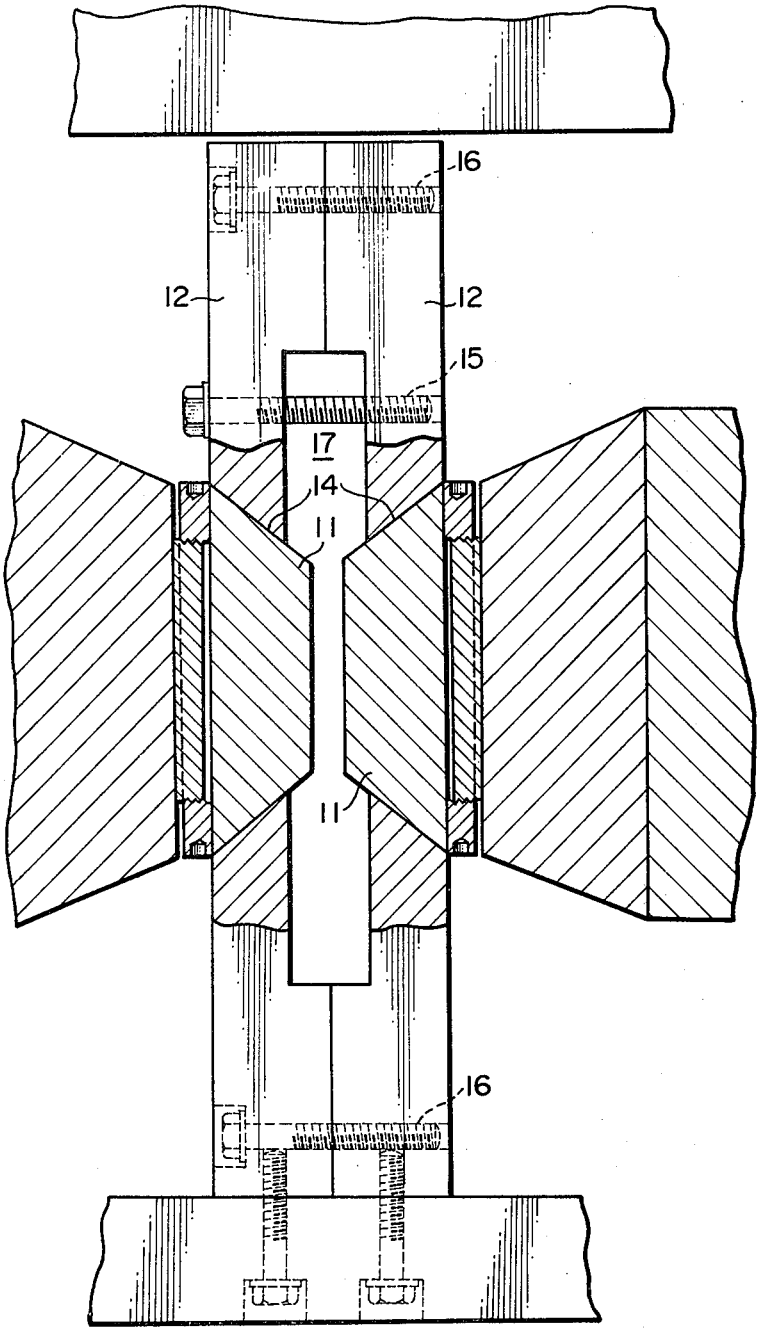
FIG. 2 PRIOR ART
FIG. 2 is a cross-sectional view showing how the pole pieces are conventionally mounted in a nuclear magnetic resonance apparatus.

FIG. 3 shows in section a view of how the pole pieces are incorporated with a distance piece interposed therebetween in the mold. Here, the mold consists of an upper mold flask 21 and a lower flask 22. The upper mold flask 21 is provided with a pouring gate 23, a raiser 24, screws 25 for adjustment of parallelism and gap size, and threaded screws 26 for fastening the two mold flasks. Around the inner sides of the upper and lower mold flasks, are respectively formed circular grooves 28 and 29 for security of the pole pieces 27. The grooves each are for example 1 mm deep and 50 $mm^{-0+0.01}$ in diameter. By applying the ends of the pole pieces into the respective grooves in shrinkage fit after the mold having been pre-heated, the pole pieces can be easily fixed relative to the mold. Each pole piece includes a frusto-conical portion 32 and a cylindrical portion 33 integral with the portion 32, between which portions 32 and 33 an annular grooves 34 are formed circumferentially of the cylindrical portion 33. With the pole pieces being so configured, it is possible to substantially eliminate the occurrence of parallelism errors caused by the withdrawal of the distance piece. To realize alignment of the pole pieces, the upper and lower mold flasks are formed around their interfaces with faucet grooves 30. As to the parallelism and air gap size between the pole pieces, it is intended that after having the distance piece interposed between the pole pieces upon pre-heating of the mold, the screws 25 for adjustment of parallelism and gap size are screwed up with a given torque thereby setting those two target values at predetermined ones.

Figure 4:
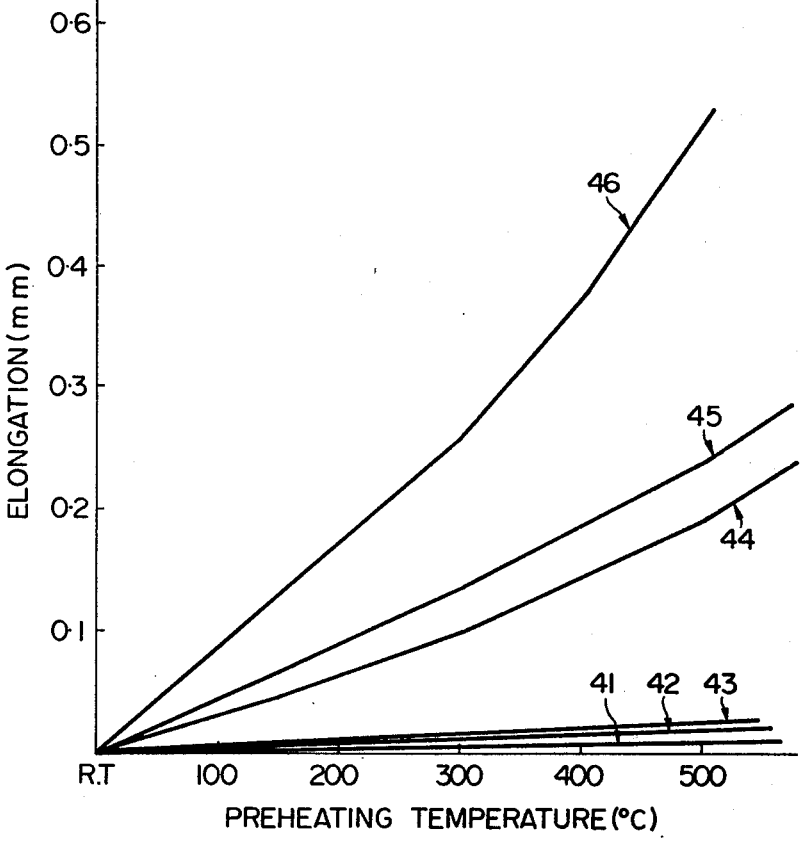
FIG. 4 is a graphic representation of the relation between pre-heating temperatures and elongation in a member employed in the invention.

For a subsequent step to remove the distance piece from the pole pieces which have been integrally cast, differences in coefficients of thermal expansion of the respective members shown may advantageously be utilized. In FIG. 4, there is shown the relation of elongation to temperature for the respective members. In the figure, reference numerals 41, 42 and 43 indicate distance pieces of carbon, tungsten and molybdenum, respectively. 44 indicates pole pieces, 45 mold and 46 indicates integral casting binder material (aluminum). Prior to the fixing of the pole pieces in the mold, the mold having the distance piece and pole pieces disposed therein is pre-heated up to for example 400° C., the mold showing the rate of expansion greater than that of the pole pieces, upon which the adjusting screws 26 are screwed up. As pre-heated, there occurs a gap between the pole pieces 27 and the surface of the central groove 28, which necessitates a further screwing-up of the adjusting screw 25 thereby fixing the pole piece 27 against the mold surface in opposition to the screw 26. Then, the integral casting binder is poured in, and when cooled, there is provided a gap of at least 0.15 mm or so between the distance piece 31 and pole piece 27. Accordingly, the distance piece 31 can be instantly drawn out from the pole pieces. The pole pieces fabricated in the above manner have a gap size therebetween with an accuracy of parallelism not exceeding 5μ.

Next, the invention will be described of its practice.

EMBODIMENT (I)

Magnet pole pieces for a nuclear magnetic resonance apparatus were casting fixed integrally by use of a mold as shown in FIG. 3. Prior to the setting of the pole pieces in the mold, the mold was coated over its inner surfaces with paints (mixture of sodium silicate and alumina) which was then dried for prevention of seizure between the mold and binder metal. Subsequently, the pole pieces were fitted in the central grooves on the upper and lower mold flasks, and then a distance piece in the form of a carbon plate 31 was inserted between the pole pieces. The mold was pre-heated from outside up to approx. 400° C. After the pre-heating, the upper mold flask was screw fastened by a given torque of 10 Kg.cm, and the screws (made of molybdenum) for adjustment of parallelism and gap size between the pole pieces were screwed up by a given torque of 20 Kg.cm. After this, a molten metal 35 of aluminum for integral casting was poured in the mold through the gate.

After the above casting, the mold was detached and the distance piece was pulled out. Table 2 shows gap sizes provided after the withdrawal of the distance piece.

TABLE 2

| Distance from the lateral end of the pole piece (mm) | 5 | 10 | 15 | 20 | 25 | 30 | 35 | 40 |
|---|---|---|---|---|---|---|---|---|
| Gap size (mm) | 10.004 | 10.002 | 10.000 | 10.002 | 10.001 | 10.002 | 10.003 | 10.005 |

As apparent from Table 2, the gap size between the pole pieces shows a range of deviation from 1μ to 5μ; the extent of misalignment therebetween was less than 10μ.

EMBODIMENT (II)

As integral casting binder, a molten metal of Al—Si alloy consisting of 11.4% Si and Al for the remainder was poured in the mold through the gate otherwise under the same condition as the embodiment (I). Annealing was effected at a temperature of 300° C. for removal of residual stresses after which the mold is detached and the distance piece was pulled out. The resultant gap size after the removal of the distance piece showed an accuracy of less than 3μ in respect of parallelism.

The pole pieces thus fixed through the integral casting described above according to the invention may be set at a predetermined position in a nuclear magnetic resonance apparatus for immediate use.

As obvious from the foregoing, the invention includes the steps of fixing pole pieces integrally in a mold through the medium of an integral casting binder and uniting the pole pieces as one body with a predetermined gap therebetween, so that the conventional steps of mechanical adjustments e.g. aligning the pole pieces and adjusting the extent of parallelism therebetween for the purpose of providing uniform magnetic field, are rather simplified, and a desired accuracy in dimension is obtainable in a short time. Furthermore, the invention is advantageous in that because of mechanical adjustments being almost dispensed with there will occur no undue strain to the pole pieces and other members hence secular changes therein being diminished; the fixing of the pole pieces with an integral casting binder assures no problem due to vibrations or shocks, thus constant mechanical accuracy is maintained. Therefore, a nuclear magnetic resonance apparatus employing pole pieces constructed according to the invention has a remarkably stable analyzing power.

What is claimed is:

1. In a magnetic field generating device for providing a uniform magnetic field in a gap in a magnetic apparatus, the improvement comprising a single integrated pole piece means having a couple of pole pieces opposite to each other, said pole pieces being parallel to and spaced from each other, and in faced alignment relation to each other, to provide said gap, and a casting material of non-magnetic metal being integral and in a direct contact relation to surfaces of both the pole pieces with the exception of at least gap-defining surfaces on said pole pieces, whereby the casting material integrally fixes the couple of pole pieces to each other.

2. In a magnetic field generating device as set forth in claim 1, wherein the integral casting material of non-magnetic metal has a melting point below the magnetic annealing temperature of the pole pieces, and the coefficient of thermal expansion of said material is more than $13\times10^{-6}$.

3. In a magnetic field generating device as set forth in claim 1, wherein said integral casting material of non-magnetic metal is aluminum-silicon alloy consisting of 8% to 13% silicon and aluminum for the remainder.

4. In a magnetic field generating device as set forth in claim 1, wherein each pole piece includes a frusto-conical portion, a cylindrical portion integral with said frusto-conical portion and an annular groove formed around the boundary between the frusto-conical portion and the cylindrical portion and circumferentially of the cylindrical portion.

5. In a magnetic field generating device as set forth in claim 4, wherein said frusto-conical portion of each pole piece has a first end portion opposite to an end portion adjacent said boundary between the frusto-conical portion and the cylindrical portion, each said first end portion having a planar surface which is parallel to and spaced from the corresponding first end portion of the other pole piece, and in faced alignment relation to the corresponding first end portion of the other pole piece, to provide said gap.

6. In a magnetic field generating device as set forth in claim 1, wherein both pole pieces and integral casting material form a single body.

7. In a magnetic field generating device as set forth in claim 1, wherein the integral casting material is selected from the group consisting of aluminum, aluminum-silicon alloy, zinc and bismuth.

8. In a magnetic field generating device as set forth in claim 1, wherein said pole pieces are made of Fe—Co alloy, and the melting point of the integral casting material is less than 850° C.

9. In a magnetic field generating device for providing a uniform magnetic field in a gap in a magnetic apparatus, the improvement comprising, a single integrated pole piece means having a couple of pole pieces opposite to each other, said pole pieces being parallel to and spaced from each other, and in faced alignment relation to each other, to provide said gap, and a casting material of non-magnetic metal integrally fixing the couple of pole pieces to each other, said material being integral and in a direct contact relation to surfaces of both the pole pieces with the exception of at least gap-defining surfaces of said pole pieces, said gap being provided by causing distance pieces to be in direct contact with both of said gap defining surfaces and then removing the distance pieces.

10. In a magnetic field generating device as set forth in claim 9, wherein the removal of the distance pieces is effected by utilization of the difference of coefficient of thermal expansion among the distance pieces, the pole pieces and the casting material.

11. In a magnetic field generating device as set forth in claim 9, wherein the coefficient of thermal expansion of said distance pieces do not exceed $5\times10^{-6}$.

12. In a magnetic field generating device as set forth in claim 9, wherein the distance pieces are made of a material selected from the group consisting of carbon, molybdenum, tungsten, fiber reinforced carbon, fiber reinforced molybdenum, and fiber reinforced tungsten.

13. In a magnetic field generating device as set forth in claim 9, wherein said distance pieces are in direct contact with both of said gap defining surfaces prior to casting said casting material and are removed after casting said casting material.

* * * * *